US005507929A

United States Patent [19]

Brochu et al.

[11] Patent Number: 5,507,929

[45] Date of Patent: Apr. 16, 1996

[54] SUBMERGIBLE ELECTRODE APPARATUS FOR DIALYSIS

[75] Inventors: Ronald P. Brochu, Beverly; Michael J. Fagundes, Dracut; Sean M. Brown, Millbury, all of Mass.

[73] Assignee: Koch Membrane Systems, Inc., Wilmington, Mass.

[21] Appl. No.: 278,187

[22] Filed: Jul. 21, 1994

[51] Int. Cl.[6] ..... C25D 17/10

[52] U.S. Cl. ..... 204/280; 204/282

[58] Field of Search ..... 204/280, 282, 204/301

[56] References Cited

U.S. PATENT DOCUMENTS

| | | | |
|---|---|---|---|
| 3,772,178 | 11/1973 | Wilson | 204/280 |
| 4,711,709 | 12/1987 | Inoue | 204/282 |
| 5,049,253 | 9/1991 | Izuo et al. | 204/301 |

OTHER PUBLICATIONS

*EDCORE Flushable Anodes* brochure from Koch Membrane Systems, Inc., Jul., 1992.

*TubeCell Anode Cells* brochure from CelTech, Inc., publication date unknown to applicant.

*High Performance HP–CA Co–Axial Cylindrical Anolyte Cells for Electro–coating Systems* brochure from Alcore Fabricating Corp., Oct. 15, 1991.

*Primary Examiner*—John Niebling
*Assistant Examiner*—Kishor Mayekar
*Attorney, Agent, or Firm*—Shook, Hardy & Bacon

[57] ABSTRACT

An electrode apparatus for dialysis of a liquid during electrodeposition processes includes an elongated body submergible in the liquid and having a generally open interior for receiving an elongated electrode therein. An ion exchange membrane forms a portion of the body and permits a filtrate to flow from the liquid through the membrane and enter the open interior of the body. An anolyte enters the body through an anolyte inlet, and an anolyte outlet removes anolyte and filtrate from the body. An electrical cable or conductor is joined to the electrode at a connection within the body to provide an electrical charge to the apparatus. A liquid-tight chamber formed within the body contains the electrical cable and electrode connection and retains them in liquid isolation from the anolyte and filtrate within the body as well as from the liquid within the electrodeposition container. Access is provided to the chamber to permit servicing of the connection.

5 Claims, 1 Drawing Sheet

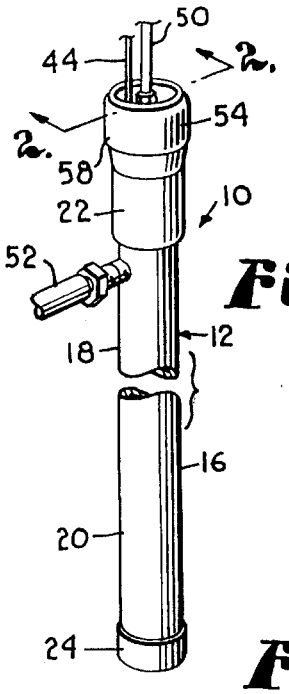
Fig. 1.
Fig. 2.
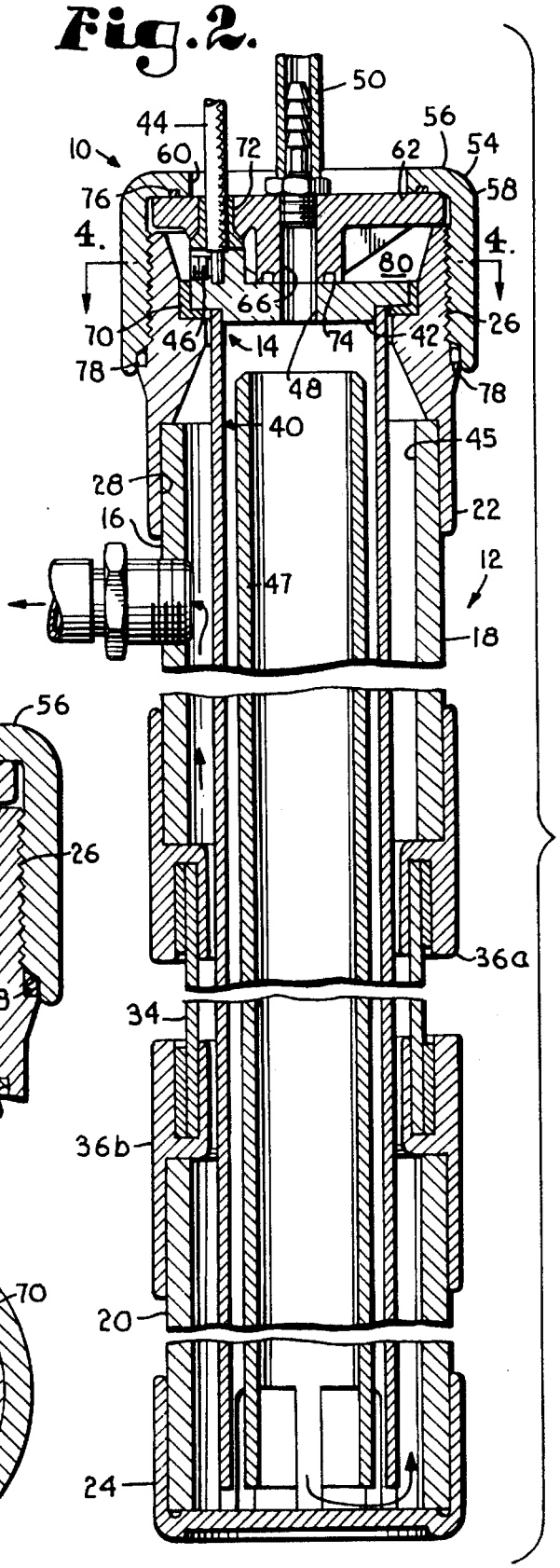
Fig. 3.
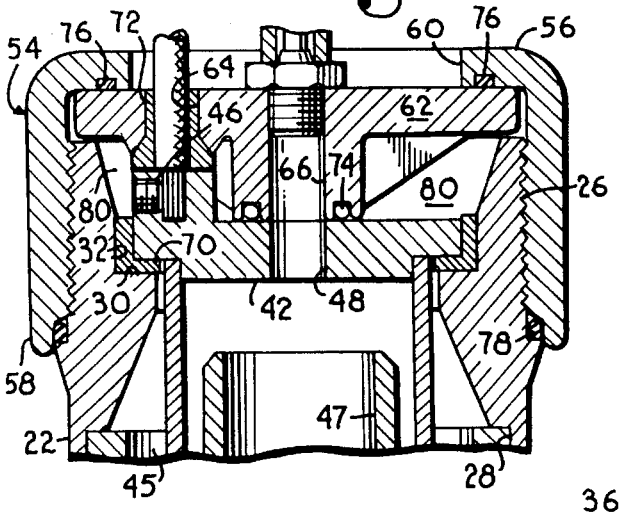
Fig. 4.
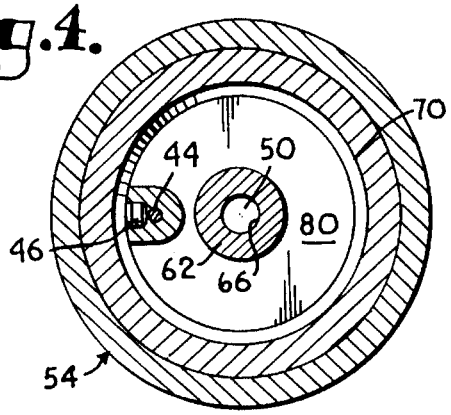

SUBMERGIBLE ELECTRODE APPARATUS FOR DIALYSIS

BACKGROUND OF THE INVENTION

This invention relates in general to an electrode apparatus for dialysis of a liquid, and, more particularly, to an electrode apparatus for dialysis which is completely submergible below the surface level of a fluid in a container.

Electrodeposition is a process by which coatings are applied to the surface of an object by the action of an electrical current. The process utilizes an electrodeposition tank or bath filled with a cationic or anionic solution containing a coating to be deposited onto an object, with the coating having a known degree of ionization allowing it to be affected by an electrical current. The object to be coated, or substrate, is placed into the solution into the tank and a source of electrical current is connected thereto. An electrode-type device is then introduced into the solution in spaced relationship from the substrate and serves as an oppositely charged counterelectrode to the substrate. The electrical forces thus created cause the coating to be attracted to and thereby deposited onto the substrate.

In both anionic and cationic electrocoating processes, it is often necessary to add a neutralizer, i.e. an alkali or an acid, to the ionic coating solution in order to adjust the electroconductivity thereof. An ion exchanger or electrodialysis membrane is used as part of the electrode apparatus to separate the counter-electrode from the solution within the electrodeposition tank, and excess alkali or acid within the solution is then dialyzed and removed therefrom through the membrane.

An electrode device commonly utilized for these electrocoating or electrodeposition applications serves as both a counterpart electrode for the object which is to be coated or painted, and as a dialysis device for the removal of excess neutralizer from the solution. In these devices, the electrode is separated from the solution by a membrane generally surrounding at least a portion of the electrode and through which the neutralizer flows. A space is provided within the device between the membrane and the electrode for accumulation of the neutralizer during filtration. During the electrodeposition coating process, the charged electrode of this dialysis-type device provides direction to the coating. The opposite electrical charge provided to the substrate attracts the coating thereto, and the coating is thereby deposited onto the substrate. An ion exchanger or electrodialysis membrane barrier is provided within the device to prevent the passage of any metal ions from the electrode into the electrodeposition tank during this process, but allow for the passage of the neutralizer filtrate from the solution into the device.

It is necessary to remove the excess neutralizer from the solution because the concentration of the neutralizer increases as electrodeposition occurs. Neutralizer that passes through the membrane barrier is flushed from the area between the electrode and the membrane by an anolyte fluid. This anolyte fluid enters the device and flows first through the electrode, and then through the area between the electrode and the membrane. As the anolyte solution flows within the electrode device, it accumulates any excess neutralizer which has been drawn through the membrane by the charge of the electrode. The anolyte and filtrate mixture is removed from the device through an anolyte discharge port.

The electrode devices used in electrodeposition processes have traditionally been positioned in the electrodeposition tank in such a manner that the electrical connections serving to supply the charge to the electrode are retained above the fluid level of the aqueous solution in the tank. More recently, submergible electrode devices have been developed which can be positioned within the electrodeposition tank completely below the fluid level of the electrodeposition solution therein. One problem that occurs with these submergible devices is that the electrical connection within the devices are exposed to the fluids which are involved in the electrodeposition process. Such exposure can produce corrosion of the wiring or electrode, with resultant failure of the electrode cell due to breakage of the electrical connection.

In order to remedy this problem, the electrical connection in submergible electrode devices is conventionally protected by one of two primary methods. First, the electrical connection of the electrode can be permanently sealed using a type of sealing material such as glass fiber and epoxy potting. This method contemplates continued placement of the electrical connection within the fluid stream in a permanent seal which protects it from the fluid stream. The second conventional method permanently pots the entire interface surrounding the electrical connection in an epoxy slug to completely insulate it from the fluid stream. Both of these methods, however, are extremely labor and cost intensive. In addition, as the electrical connection is permanently potted or insulated, the entire electrical connection must be replaced and repotted in a labor intensive process whenever maintenance on the connection is required.

SUMMARY OF THE INVENTION

It is therefore an object of the present invention to provide an electrode apparatus for dialysis which is submergible below the level of a fluid in the electrodeposition tank so as to maintain the integrity of the electrical connections within the apparatus.

It is another object of the present invention to provide a submergible electrode apparatus having an isolated electrical connection so that the need to physically and permanently seal or pot the electrical connection within the electrode apparatus is eliminated.

It is yet another object of the present invention to provide a submergible electrode apparatus which utilizes a fluid-tight chamber within the apparatus so that the chamber surrounds and protects the electrical connection from any contact with the anolyte, filtrate and electrodeposition fluids, but allows access to the connection to permit servicing thereof.

It is still another object of the present invention to provide a submergible electrode apparatus wherein the electrical connection is isolated within the apparatus so that the connection is maintained remote from contact with the fluid streams within the apparatus.

It is a still further object of the present invention to provide a submergible electrode apparatus for dialysis having a seal design with enhanced reliability in order to isolate the electrical connection from the fluids.

It is yet a further object of the present invention to provide a submergible electrode apparatus for dialysis having a connection that eliminates the need for potting or permanent affixation of the electrical connection so that the apparatus can be completely and easily assembled or maintained on site.

To accomplish these and other related objects of the invention, the submergible electrode device of the present invention utilizes an fluid-tight or dry chamber within which the electrical connection is made. The chamber protects the electrical connection from any contact with the fluid streams and thereby reduces the incidence of fluid induced corrosion of the connection. The chamber is provided with an access passage to permit servicing without requiring replacement of the connection as is often necessary in those conventionally potted devices having an electrical connection permanently affixed to the device by use of glass fiber, epoxy resin or the like.

BRIEF DESCRIPTION OF THE DRAWINGS

In the accompanying drawings which form a part of the specification and are to be read in conjunction therewith and in which like reference numerals are used to indicate like parts in the various views:

FIG. 1 is a fragmentary perspective view of an embodiment of the electrode apparatus of the present invention;

FIG. 2 is an enlarged fragmentary vertical cross-sectional view of the electrode apparatus taken along line 2—2 of FIG. 1;

FIG. 3 is a still further enlarged fragmentary cross-sectional view of the fluid-tight chamber of the electrode apparatus of FIG. 2; and FIG. 4 is a horizontal cross-sectional view of the electrode apparatus taken along line 4—4 of FIG. 2.

DESCRIPTION OF THE PREFERRED EMBODIMENT(S)

Turning now to the drawings in greater detail, and initially to FIGS. 1 and 2, an electrode apparatus embodying the principles of this invention is designated by the numeral 10 and comprises an elongated tubular body 12 and an elongated electrode assembly 14 disposed essentially concentrically within the body 12.

The body 12 has a generally open interior and comprises an elongated tubular frame 16 having first and second segments, 18 and 20 respectively, which are disposed in both a coaxial and a coplanar orientation with respect to each other. Segments 18 and 20 can be made of PVC or other suitable plastic material. Frame 16 is open at the opposed ends of first and second segments 18 and 20, with an upper adapter 22 and a lower adapter 24, respectively, fitted on such opposed ends. Upper adapter 22 is a generally ring-shaped sleeve having an outer threaded portion 26 at one end thereof and an inner mating portion 28 at the opposed end. Mating portion 28 is designed to receive an upper portion of first segment 18 of frame 16, with the diameters of mating portion 28 and first segment 18 being selected so that a satisfactory fit is achieved. The inner portion of upper adapter 22 at the end opposed to mating portion 28 is recessed and includes an annular inner seat 30 having an inner wall 32 extending upwardly therefrom. Lower adapter 24 substantially closes the opposed open end of second segment 20 of frame 16.

Body 12 additionally comprises a tubular ion exchange membrane 34 positioned coaxially between first segment 18 and second segment 20. Membrane retention members **36*a* and 36*b* are attached to the facing ends of first segment 18 and second segment 20, respectively, and securely retain membrane 34 to segments 18 and 20 of frame 16**.

The electrode assembly 14 comprises an elongated hollow tubular electrode 40 positioned essentially concentrically within frame 16 and spaced a predetermined distance therefrom, an electrode lid 42 fitted to the upper end of the tubular electrode 40 to rigidly retain the electrode 40 in position within apparatus 10, and an electrical conductor or cable 44 for connecting the electrode 40 and the electrode lid 42 with a source of electrical current. A set screw 46 is provided for securely retaining electrical cable 44 in electrical contact with electrode lid 42. Electrode lid 42 contains an aperture 48 therein adapted to receive and form a communicating portion of an anolyte inlet 50 and thereby allow for the passage of anolyte from anolyte inlet 50 through aperture 48 of electrode lid 42 and into the interior of electrode 40. Anolyte discharge 52 extends away from first segment 18 of frame 16 between membrane retention member **36*a* and upper adapter 22 to remove anolyte and filtrate from the electrode apparatus 10**.

The outer diameter of electrode 40 is smaller than the inner diameter of frame segments 18 and 20, as well as of membrane 34, to allow for ease in insertion and removal from the apparatus 10. Additionally, an annular space 45 thus created between electrode 40 and frame segments 18 and 20, as well as membrane 34, is provided to allow for passage of the anolyte or other fluid therethrough during the electrodeposition process as described in more detail below.

The electrode 40 and the electrode lid 42 can be made of stainless steel, or of any other material suitable for forming an electrode. In addition, it should be understood that, although body 12 and electrode 40 are depicted as being tubular in shape, any suitable shape of body or electrode can be utilized in this apparatus, and any such shape is contemplated as being within the scope of this invention.

In the embodiment shown, an elongated hollow support tube 47 can be provided and is spaced from and positioned concentrically within electrode 40, wherein support tube 47 extends longitudinally from a point spaced from electrode lid 42 to a point spaced from lower adapter 24.

Anolyte enters apparatus 10 through anolyte inlet 50 and passes through the open interior of electrode 40. When it reaches the opposed end of apparatus 10, it flows in the direction indicated by the arrows to annular space 45 between electrode 40 and frame segments 18 and 20, as well as membrane 34. Filtrate which has passed through membrane 34 and accumulates in annular space 45 mixes in this region with the anolyte, and such mixture exits apparatus 10 through anolyte discharge 52.

Referring in more detail to FIGS. 2 and 3, body assembly 12 further includes a compression cap 54 having an end cover 56 and an integral collar 58 extending therefrom and threadably secured to upper adapter 22 as shown in the drawing. End cover 56 is provided with an opening 60 to allow for the passage of electrical cable 44 and anolyte inlet 50 therethrough. A seal plate 62 is positioned between compression cap 54 and electrode lid 42. Seal plate apertures 64 and 66 are provided to also allow for the passage of electrical cable 44 and anolyte inlet 50, respectively, through the seal plate 62. Seal plate 62 is positioned within apparatus 10 in such a manner to align seal plate aperture 66 with electrode lid aperture 48 and thereby create a path of fluid communication allowing for the passage of anolyte from anolyte inlet 50 into electrode 40. Similarly, opening 60 in compression cap 54 cooperates with seal plate apertures 64 and 66 to allow electrical cable 44 and anolyte inlet 50 to extend through the cap 54.

The removable compression cap 54 of the embodiment shown creates an access passage through which it is possible to easily access the electrical connection within apparatus 10, whereby the electrical connection can be serviced without unnecessary replacement or destruction of any parts of the electrical connection or of the body 12.

Although a threaded cap 54 is depicted in the drawings, it is contemplated that any suitable non-permanent closure means creating access to the electrical connection can be utilized. For example, a top means connected to a body as by bolting or the like can be employed in place of the threaded cap 54.

A chamber 80 is provided and is made fluid-tight by a seal assembly as depicted most clearly in FIGS. 2 and 3. The seal assembly consists of several O-ring and special profile seals. An electrode seal 70 having an annular face and side walls extending therefrom, which are designed to follow and securely engage the surfaces of inner seat 30 and inner wall 32 of upper adapter 22, is positioned at these locations as shown in the drawings. A cable seal 72 is designed to securely conform to the shape of seal plate aperture 64, and is adapted to be securely received within such aperture 64 about electrical cable 44.

An anolyte seal 74 is positioned in seal plate 62 adjacent the area of contact between the lower portion of seal plate 62 and electrode lid 42 in surrounding relationship adjacent both seal plate aperture 66 and electrode lid aperture 48. Anolyte seal 74 is typically an o-ring type construction. Seal plate 62 also houses a compression cap seal 76, also typically an o-ring seal type construction, adjacent the region of contact between the upper portion of seal plate 62 and compression cap 54 in surrounding relationship adjacent opening 60 of compression cap 54. An upper adapter seal 78 is also typically an o-ring type construction, and is positioned around the outer circumference of upper adapter 22 adjacent and below threaded outer portion 26, in a region of contact between upper adapter 22 and the distal end of collar 58 of compression cap 54. The seal assembly is adapted to provide a fluid-tight or dry chamber 80 in which the electrical connection between the electrical cable 44 and electrode lid 42 can be made while at the same time being insulated from any fluid surrounding or within the electrode apparatus 10.

During the electrodeposition process, the submerged apparatus 10 is positioned below the fluid level of the aqueous electrodeposition solution within an electrodeposition tank. A portion of this solution, the filtrate, travels from the aqueous solution into electrode apparatus 10 through membrane 34. This filtrate comes into contact with electrode 40 within annular space 45, and is flushed away by a circulating stream of anolyte which enters apparatus 10 through anolyte inlet 50, flowing through the open interior of electrode 40 and then into annular space 45, and finally exits through anolyte discharge 52. The seal assembly isolates chamber 80 in a fluid-tight manner from both the electrodeposition stream and the anolyte stream, as well as any filtrate within the apparatus, preventing the electrical connection from coming into contact with any of the fluids in the electrodeposition process. Fluid-tight chamber 80 allows the apparatus 10 to be operated in a fully submerged manner without compromising the integrity of the electrical connection.

The seal assembly of apparatus 10 is employed in the following manner. Special profile electrode seal 70 is placed within recessed inner seat 30 of upper adapter 22, fitting securely against both inner seat 30 and inner wall 32. Electrode assembly 14 is then positioned within apparatus 10, with electrode lid 42 positioned securely against electrode seal 70. This positioning results in an axial compression sealing against inner seat 30 of upper adapter 22, as well as a radial compression against inner wall 32. Electrode seal 70 prevents the passage of anolyte and filtrate into fluid-tight chamber 80. Cable seal 72, anolyte seal 74 and compression cap seal 76 are positioned within seal plate 62 as described above, and seal plate 62 is placed in apparatus 10 adjacent electrode lid 42. Electrode cable 44 is fed through seal plate 62 and cable seal 72, and is then securely compressed into electrode lid 42 by set screw 46. Anolyte seal 74 effects a sealing with respect to the anolyte feed stream and prevents the anolyte from entering fluid-tight chamber 80. Cable seal 72 forms a fluid-tight juncture between seal plate 62 and cable 44, preventing the electrodeposition solution from entering chamber 80. Compression cap seal 76 further effects a sealing of fluid-tight chamber 80 between seal plate 62 and compression cap 54 by preventing the aqueous electrodeposition solution from entering chamber 80 when the apparatus 10 is submerged. Finally, upper adapter seal 78 is loaded about the outer circumference of upper adapter 22 below threaded portion 26 and compression cap 54 is then tightened into position by threading, compressing upper adapter seal 78 between upper adapter 22 and compression cap 54, and placing the entire assembly into axial compression. Upper adapter seal 78 effects a sealing of chamber 80 from the aqueous electrodeposition solution within the tank.

As discussed above, cap 54 telescopes over upper adapter 22 and, when threadably turned in the direction to tighten the cap 54 thereon, compresses the seal assembly and effects the fluid-tight seal surrounding the chamber 80. In addition, when cap 54 is loosened from upper adapter 22 by being threadably turned in the opposite direction, the sealing effect and the assembly components defining and surrounding the chamber 80 are released to provide access to the chamber 80 for servicing, which can include any necessary contact with the connection from simple maintenance to replacement thereof.

The fluid-tight chamber 80 formed, in this embodiment, by a combination of seals efficiently and effectively achieves the desired protection and insulation of the electrical connection even when the apparatus 10 is fully submerged, without the need to pot or otherwise permanently affix the components of the electrical connection in the conventional labor intensive methods used prior to this invention. Although the embodiment disclosed herein depicts a specific seal assembly, it is understood that other combinations of seals or other methods of achieving the fluid-tight chamber 80 of apparatus 10 are contemplated as being within the scope of this invention. In addition, although apparatus 10 is primarily discussed with respect to an electrodeposition process, the apparatus 10 having the fluid-tight chamber 80 therein can be used in any filtration application in which an electrode or counterelectrode is desired, and in which a membrane is required to separate a by-product from a fluid.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A submergible electrode apparatus for dialysis of a liquid in a container, said apparatus comprising:

an elongated body adapted to be submerged in the liquid in the container and having opposed first and second end portions and a generally open interior through which liquid anolyte passes, said body having a threaded portion adjacent said first end;

a threaded cover adapted to be received by the threaded portion of said body and having an access opening therein;

an elongated tubular electrode disposed within said body and adapted to receive said fluid anolyte;

means for providing a fluid seal at one end of said electrode and for electrically coupling said electrode with an electrical conduit, said means comprising a substantially disk-shaped electrically conductive lid received in fluid tight communication with one end of said electrode and having an opening for the passage of liquid anolyte, said means further comprising a non-conductive seal plate positioned between said lid and said cover and having a first opening aligned with said lid opening for the passage of liquid anolyte and a second opening for receiving an electrical conduit, said means for providing said fluid seal cooperating with said threaded portion of the body to present a sealed chamber for accommodating an electrical connection;

an electrical conduit received by said second opening and electrically connected to said lid;

means received by said lid for removably connecting said conduit with said lid; and sealing means for providing fluid tight seals to preclude the passage of liquid from said container and anolyte passing through said electrode into said chamber.

2. The apparatus as set forth in claim 1, wherein said sealing means comprises a first seal between said cover and said seal plate, a second seal between said seal plate and said lid, and a cable seal for fluid sealing of said conduit and said seal plate.

3. The apparatus as set forth in claim 1, wherein said means for removably connecting said conduit to said lid comprises a set screw.

4. The apparatus of claim 2, wherein said sealing means further comprises a third seal between said cover and said body.

5. The apparatus of claim 4, wherein said first, second and third seals are o-ring compression seals.

* * * * *